US009170025B2

(12) United States Patent
Atemboski et al.

(10) Patent No.: US 9,170,025 B2
(45) Date of Patent: Oct. 27, 2015

(54) HYBRID WOOD BURNING FIREPLACE ASSEMBLY

(71) Applicant: Travis Industries, Inc., Mukilteo, WA (US)

(72) Inventors: Alan R. Atemboski, Renton, WA (US); Kurt W. F. Rumens, Kirkland, WA (US); Russell A. McBrian, Mukilteo, WA (US); Jeremy Halston, Lynnwood, WA (US)

(73) Assignee: Travis Industries, Inc., Mukilteo, WA (US)

( * ) Notice: Subject to any disclaimer, the term of this patent is extended or adjusted under 35 U.S.C. 154(b) by 87 days.

(21) Appl. No.: 14/029,740

(22) Filed: Sep. 17, 2013

(65) Prior Publication Data

US 2014/0109806 A1 Apr. 24, 2014

Related U.S. Application Data

(63) Continuation of application No. 13/047,714, filed on Mar. 14, 2011, now abandoned.

(60) Provisional application No. 61/313,678, filed on Mar. 12, 2010.

(51) Int. Cl.

| | |
|---|---|
| ***F24B 1/02*** | (2006.01) |
| ***F24B 1/00*** | (2006.01) |
| ***F23J 15/02*** | (2006.01) |
| ***F24B 1/19*** | (2006.01) |
| ***F24B 9/00*** | (2006.01) |
| ***F24B 13/00*** | (2006.01) |

(52) U.S. Cl.

CPC ..... *F24B 1/026* (2013.01); *F23J 15/02* (2013.01); *F24B 1/006* (2013.01); *F24B 1/19* (2013.01); *F24B 9/006* (2013.01); *F24B 13/00* (2013.01)

(58) Field of Classification Search

CPC ..... F24B 1/026; F24B 1/19; F24B 13/00; F24B 9/006; F24B 5/026; F24B 5/028; F23J 15/02; F23L 9/02

USPC ..... 110/214, 210; 237/50, 52, 53

See application file for complete search history.

(56) References Cited

U.S. PATENT DOCUMENTS

2008/0041357 A1* 2/2008 Brown ..... 126/77

* cited by examiner

*Primary Examiner* — Alfred Basichas

(74) *Attorney, Agent, or Firm* — Perkins Coie LLP

(57) ABSTRACT

A hybrid wood-burning fireplace assembly configured for burning wood-based fuel, wherein the burning generates combustion exhaust. The assembly comprising a fire box having an interior area, a baffle in the interior area defining lower and upper combustion chambers relative to the baffle. The upper combustion chamber has an upper exhaust passageway between baffle and the top portion of the firebox. A secondary combustion airway has air outlets in the firebox that direct the secondary combustion air adjacent to the baffle to mix with the exhaust for non-catalytic secondary combustion of the exhaust before the exhaust flows through the upper exhaust passageway. A catalytic combustion unit is positioned above the baffle and across the upper exhaust passageway, whereby the exhaust will pass through the catalytic combustion unit after the non-catalytic secondary combustion of the exhaust and before the exhaust exits the upper combustion chamber through the upper exhaust passageway.

20 Claims, 5 Drawing Sheets

HYBRID WOOD BURNING FIREPLACE ASSEMBLY

CROSS-REFERENCE TO RELATED APPLICATION(S)

This application is a continuation of U.S. patent application Ser. No. 13/047,714, titled HYBRID WOOD BURNING FIREPLACE ASSEMBLY and filed Mar. 14, 2011, which is a non-provisional patent application that claims priority to and claims the benefit of U.S. Provisional Patent Application No. 61/313,678, titled HYBRID WOOD BURNING FIREPLACE ASSEMBLY and filed Mar. 12, 2010, the disclosure of which is incorporated by reference in its entirety by reference thereto.

TECHNICAL FIELD

The present invention relates to fireplace assemblies, and more particularly to wood burning fireplace assemblies, including fireplace units, fireplace inserts and stoves and associated methods.

BACKGROUND

Conventional fireplace assemblies are configured to burn a selected fuel, such as wood, pellets, gas, etc., and this burning of the fuel results in exhaust that contains combustion bi-products. As an example, a wood burning fireplace assembly, such as a stove or insert, is used to burn wood in the firebox, which creates combustion bi-products (solid and gaseous) that exit the firebox as exhaust. Technology has been developed to reduce or otherwise control the emissions from the fireplace assemblies, including catalytic fireplace assemblies and non-catalytic fireplace assemblies that provide for secondary combustion of the exhaust to reduce the emissions.

Conventional catalytic fireplace assemblies having catalytic converters are generally effective in achieving low particulate emissions at low temperatures, but become less effective as temperatures rise. On the other hand, conventional non-catalytic fireplace assemblies having secondary combustion tubes are generally effective in causing secondary combustion of the combustion bi-products to achieve low particulate emissions at high temperatures, but become less effective as temperatures fall. In both cases, a bypass damper may need to be frequently controlled and/or other manual adjustments may need to be made in order to regulate the rate of combustion within the fireplace assembly.

SUMMARY

The present invention provides a fireplace assembly that overcomes drawbacks experienced in the prior art and that provide other embodiments. At least one embodiment of the invention provides a hybrid fireplace assembly, including a fireplace unit, a stove or an insert, that comprises a fire box with an interior area configured to contain a combustible fuel that will burn and generate exhaust. The firebox has a front wall, a back wall, sidewalls, a base plate, a top portion, and an exhaust outlet. A baffle is connected to the firebox and disposed in the interior area to define a lower combustion chamber below the baffle and an upper combustion chamber above the baffle. The lower combustion chamber is sized and shaped to contain at least a portion of the fire from burning combustible fuel. The upper combustion chamber has an upper exhaust passageway between baffle and the top portion of the firebox. A primary combustion air passageway configured to carry primary combustion air to the lower combustion chamber. The primary combustion air passageway having an inlet that receives air therein for primary combustion and having at least one outlet in the firebox that directs primary combustion air toward the fire in the lower combustion chamber. A secondary combustion air passageway is configured to carry secondary combustion air into the firebox. The secondary combustion air passageway has an inlet that receives air therein for secondary combustion of at least portions of exhaust from the burning of the combustible fuel in the lower combustion chamber. The secondary combustion air passageway has air outlets in the firebox that directs the secondary combustion air adjacent to the baffle to mix with the exhaust for non-catalytic secondary combustion of the exhaust before the exhaust flows through the upper exhaust passageway. A catalytic combustion unit is positioned above the baffle and across the upper exhaust passageway whereby the exhaust will pass through the catalytic combustion unit after the non-catalytic secondary combustion of the exhaust and before the exhaust exits the upper combustion chamber through the upper exhaust passageway. The catalytic combustion unit is configured to remove combustion byproducts from the exhaust when the exhaust passes through the catalytic combustion unit.

In one embodiment the secondary combustion air passageway is configured to facilitate the combustion of exhaust particles in a first range of temperatures with a first level of efficiency. The catalytic combustion unit is configured to provide combustion of exhaust particles in the first range of temperatures with a second level of efficiency less than the first level of efficiency. The secondary combustion air passageway facilitates the combustion of exhaust particles in a second range of temperatures greater than with a third level of efficiency, and the catalytic combustion unit is configured to provide combustion of exhaust particles in the range of second temperatures with a fourth level of efficiency greater than the third level of efficiency.

Another aspect of an embodiment provides a hybrid wood-burning fireplace assembly configured for burning wood-based fuel, wherein the burning generates combustion exhaust. The assembly comprising a fire box having an interior area, a base portion, and a top portion with an exhaust outlet. A baffle is in the interior area defining a lower combustion chamber below the baffle and an upper combustion chamber above the baffle. The upper combustion chamber has an upper exhaust passageway between baffle and the top portion of the firebox. A primary combustion airway has an inlet that receives primary combustion air therein and has at least one outlet in the firebox that directs the primary combustion air to the lower combustion chamber for primary combustion with the burning wood-based fuel. A secondary combustion airway has an inlet that receives air therein for secondary combustion of at least portions of exhaust from the burning wood-based fuel in the lower combustion chamber. The secondary combustion airway has air outlets in the firebox that directs the secondary combustion air adjacent to the baffle to mix with the exhaust for non-catalytic secondary combustion of the exhaust before the exhaust flows through the upper exhaust passageway. A catalytic combustion unit positioned above the baffle and across the upper exhaust passageway whereby the exhaust will pass through the catalytic combustion unit after the non-catalytic secondary combustion of the exhaust and before the exhaust exits the upper combustion chamber through the upper exhaust passageway.

Another aspect provides a method of reducing emissions from a wood-based fuel burning fireplace assembly. The method comprises burning a wood-based fuel in firebox of the fireplace assembly during primary combustion of the fuel to generate exhaust with particulates therein. The fireplace assembly has a baffle in the firebox that divides an interior area into an upper combustion chamber and a lower combustion chamber. The upper combustion chamber has an upper exhaust passageway between baffle and a top portion of the firebox. The method includes directing secondary combustion air into the lower chamber below the baffle for mixing with the exhaust for secondary combustion of the exhaust in the firebox, burning particulates in the exhaust in the secondary combustion adjacent to the baffle, and passing the exhaust after the secondary combustion through a catalytic combustion unit positioned across an exhaust passageway in the upper combustion chamber above the baffle, wherein passing the exhaust through the catalytic combustion unit removed additional particulates from the exhaust after the secondary combustion. The method can also include directing the exhaust out of the firebox after the exhaust exits the catalytic combustion unit.

DETAILED DESCRIPTION

A hybrid fireplace assembly is described in detail herein in accordance with embodiments and aspects of the present invention. In one embodiment, a hybrid wood-burning fireplace assembly includes a hybrid combustion system having both catalytic and non-catalytic components. A non-catalytic component comprises one or more secondary combustion tubes that remove particulate emissions, such as carbon monoxide, from the exhaust gases generated by a wood burning fire. A catalytic component comprises a catalytic converter that removes additional particulate emissions from the exhaust gases before the gases are emitted from the fireplace assembly. Among other benefits, the hybrid fireplace assembly described herein improves heating efficiency and achieves low particulate emissions over a wide range of temperatures.

The hybrid fireplace assembly described herein employs both a catalytic converter and secondary combustion tubes. At higher temperatures, the secondary combustion tubes are more effective at reducing particulate emissions, and the catalytic converter is used relatively less. At lower temperatures, the secondary combustion tubes are less effective at reducing particulate emissions, and the catalytic converter is used relatively more. The hybrid fireplace assembly provides a user-friendly, self-regulating system that accommodates temperature changes, without requiring excessive control of a bypass damper, opening and closing a door of the fireplace assembly, and/or making other manual adjustments.

The fireplace assembly described herein may be used in combination with wood burning fireplaces, stoves, and fireplace inserts. In the following description, numerous specific details are discussed to provide a thorough and enabling description for embodiments of the disclosure. One skilled in the relevant art, however, will recognize that the disclosure can be practiced without one or more of the specific details. In other instances, well-known structures or operations are not shown, or are not described in detail, to avoid obscuring aspects of the disclosure. In general, alternatives and alternate embodiments described herein are substantially similar to the previously described embodiments, and common elements are identified by the same reference numbers.

Figure 1:
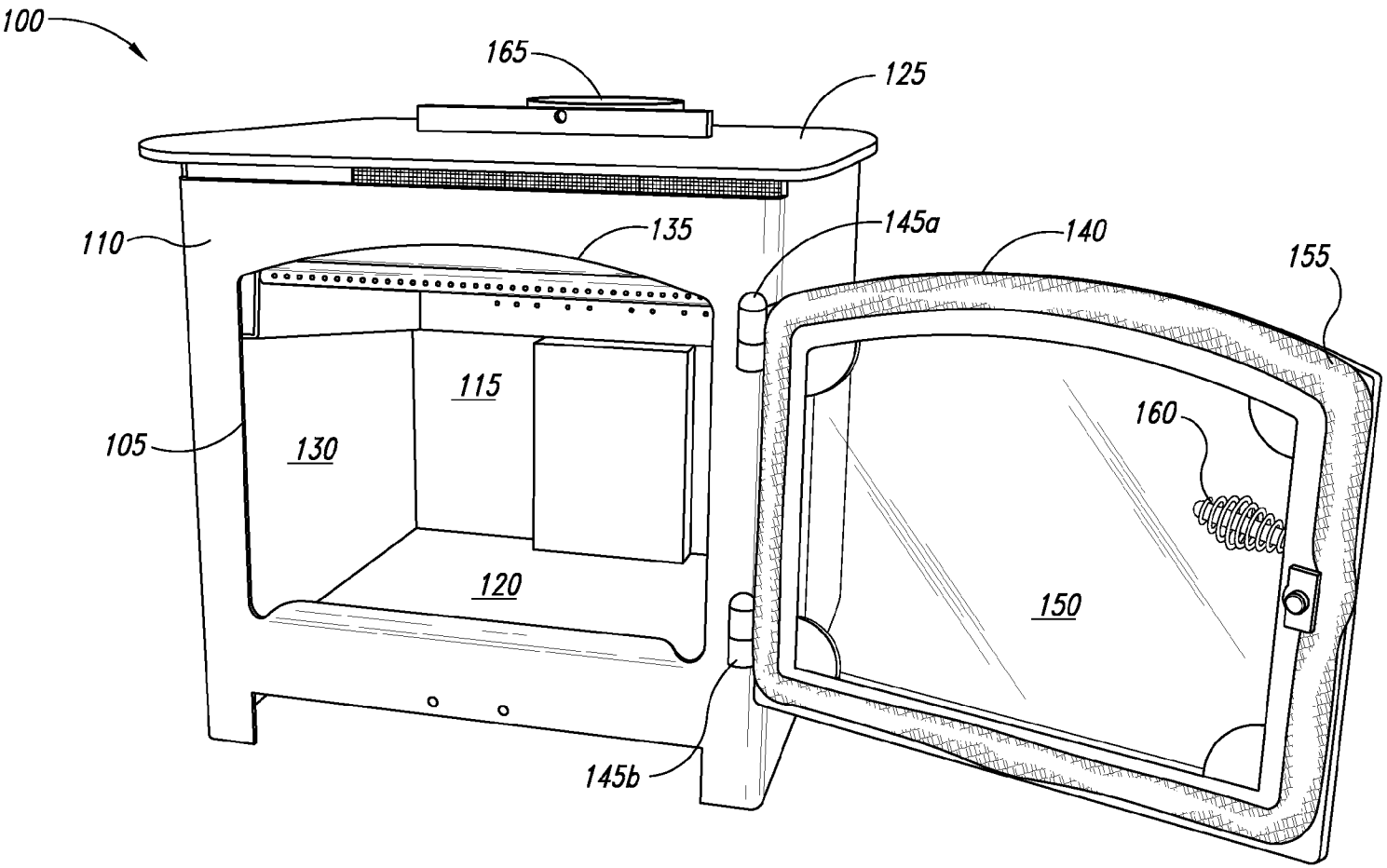
FIG. 1 is an isometric view of a hybrid wood burning fireplace assembly in accordance with an embodiment of the present invention.

FIG. 1 is a front isometric view of a hybrid fireplace assembly 100 in accordance with an embodiment of the present invention. The hybrid fireplace assembly 100 includes a firebox 105 for containing a wood burning fire. The firebox 105 comprises a front wall 110, a back wall 115, a base plate 120, a top plate 125, and sidewalls 130.

The front wall 110 of the firebox 105 includes an opening 135 for receiving wood. The opening 135 receives a door 140 mounted by hinges 145 (identified individually as a first hinge 145*a* and a second hinge 145*b*) coupled to the front wall 110. The door 140 has a glass window 150 or the like that allows the interior of the firebox 105 to be observed while the door is closed. A door seal 155 extending about the inside of the door 140 engages with the front panel 110 to provide an airtight seal when the door is closed. The door 140 also includes a handle 160 that can be rotated to latch and unlatch the door.

In the illustrated embodiment, the hybrid fireplace assembly 100 also includes a flue adapter 165 configured to receive a direct vent chimney. The flue adapter 165 can be located on the top, back, or side of the hybrid fireplace assembly 100. In an alternative embodiment, the hybrid fireplace assembly 100 includes two separate, non-concentric flues (e.g., an exhaust flue and an air intake flue) connected to the top, back, or side of the assembly.

When the hybrid fireplace assembly 100 is operated, wood is placed within the firebox 105 adjacent to the base plate 120 and ignited in a usual manner. As the fire burns, it produces exhaust gases that contain particulate emissions, such as carbon monoxide, unburned hydrocarbons, and/or other gases that may be undesirable, such as for the environment. The exhaust gases are processed by a hybrid combustion system that includes a series of combustion stages—primary, secondary, tertiary, and catalytic. At each stage of combustion, particulate emissions are removed from the exhaust gases, so that by the time the exhaust gases reach the flue adapter 165, most of the particulate emissions have been eliminated. This improved combustion of the wood fuel and the particulate emissions results in more heat produced by the same amount of wood.

Figure 2:
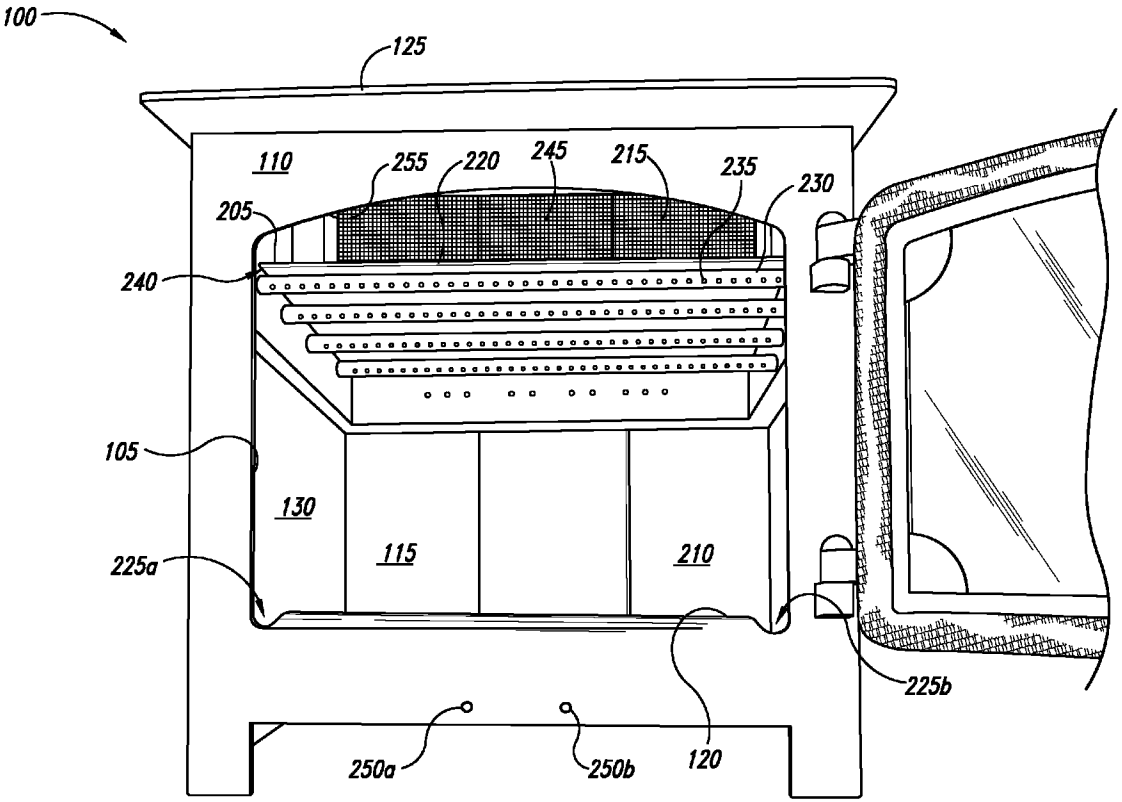
FIG. 2 is an enlarged front isometric view of the hybrid fireplace assembly of FIG. 1 showing a hybrid combustion system.

FIG. 2 is an enlarged front isometric view of the hybrid fireplace assembly 100 of FIG. 1 showing a hybrid combustion system. The firebox 105 includes a baffle 205 extending between the sidewalls 130 from the back wall 115 toward the front wall 110, and terminating in a leading edge 220 before it reaches the front wall 110. The baffle 205 separates the firebox into a lower combustion chamber 210 between the baffle and the base plate 120, and an upper combustion chamber 215 between the baffle and the top plate 125. In the illustrated embodiment, the baffle is configured so the leading edge 220 is spaced apart from the front wall to provide an exhaust/air flow path from under the baffle, up and around the leading edge between the baffle and the front wall 110 to above the baffle 205. In other embodiments, the baffle can be configured in another position or arrangement, such as to provide the leading edge adjacent to and spaced apart from, as an example, the rear wall or a side wall, so that the exhaust/air flow path is between the baffle's leading edge and the adjacent, spaced apart rear wall or side wall.

The upper combustion chamber 215 includes a catalytic component of the hybrid combustion system—a catalytic converter 245. The lower combustion chamber 210 includes a non-catalytic component of the hybrid combustion system—one or more secondary combustion air passageways, such as secondary combustion air tubes 230 affixed to the underside of the baffle 205.

In the illustrated embodiment, the baffle 205 comprises a metal plate having a top insulation layer. The insulation layer can comprise firebricks, ceramic fiber, vermiculite board, or the like. In other embodiments, the baffle 205 comprises one or more firebricks mounted on brackets. The insulated baffle 205 retains heat in the lower combustion chamber 210 below the baffle, in order to facilitate combustion at the secondary combustion tubes 230.

The location and thickness of the baffle 205 are determined based at least in part on the space needed above the baffle for the catalytic converter 245. For example, the size of the hybrid fireplace assembly 100 can affect a minimum size and/or surface area needed for optimum performance of the catalytic converter 245. A small hybrid fireplace assembly 100, which generates relatively fewer particulate emissions, may require a relatively small catalytic converter 245. Accordingly, the baffle 205 may be positioned relatively closer to the top plate 125, and/or the baffle may be relatively thicker. A large hybrid fireplace assembly 100, which generates relatively more particulate emissions, may require a relatively large catalytic converter 245. Accordingly, the baffle 205 may be positioned relatively further away from the top plate 125, and/or the baffle may be relatively thinner.

In some embodiments, the baffle 205 is substantially horizontal and parallel with the base plate 120. In other embodiments, the baffle 205 is sloped, such as upward from the rear wall 115 toward the front wall 110, such that the leading edge 220 of the baffle is higher than a rear edge of the baffle that intersects with the rear wall. The degree of slope is determined based at least in part on the size of the firebox 105. For example, a relatively large firebox 105 can generally accommodate a sloped baffle 205, while a relatively small firebox may be better suited for a horizontal baffle. The slope of the baffle 205 (or lack thereof) can affect the speed of the flow of a secondary air supply along the underside of the baffle, described in additional detail herein. A horizontal baffle 205 (i.e., with zero or approximately zero degree slope) can cause the secondary air supply to flow at a relatively slow rate. As the degree of slope of the baffle 205 increases, the secondary air supply is directed increasingly upward, and thus flows at a relatively faster rate.

Primary and secondary combustion occur in the lower combustion chamber 210 of the firebox 105. Primary combustion occurs adjacent to the base plate 120, as the burning wood comes into contact with a primary air supply and generates exhaust gases. The primary air supply can be distributed into the firebox 105 from a variety of locations, such as a primary air intake aperture 225 (identified individually as first primary air intake aperture 225*a* and second primary air intake aperture 225*b*) located in the base plate 120. The primary air intake aperture(s) 225 are fluidly coupled to a base chamber 170 on the underside of the base plate 120 that freely provides the primary air supply to the aperture(s). The primary air supply mixes with the exhaust gases adjacent to the base plate 120 and upstream of the secondary combustion tubes 230, removing particulate emissions from the exhaust gases.

In some embodiments, the primary air supply is spaced apart from the firebox 105, such that the primary air supply is not heated substantially by the firebox prior to entry via the primary air intake aperture(s) 225. For example, the base chamber 170 may be located apart from the firebox 105, and/or an insulation layer between the firebox and the base chamber may reduce the flow of heat from the firebox to the base chamber. Such an arrangement enables delivery of a maximum concentration of oxygen ($O_2$) to the base plate 120 for primary combustion.

In some embodiments, a primary air control (not shown) is provided to allow a user to selectively control the flow of the primary air supply. The primary air control can extend along the underside of the firebox 105 through a control opening 250 (identified individually as a first control opening 250*a* and a second control opening 250*b*). The primary air control can be opened completely to allow for free flow of the primary air supply through the primary air intake aperture(s) 225, or the primary air control can be progressively closed to reduce the flow of the primary air supply through the primary air intake aperture(s).

Figure 3:
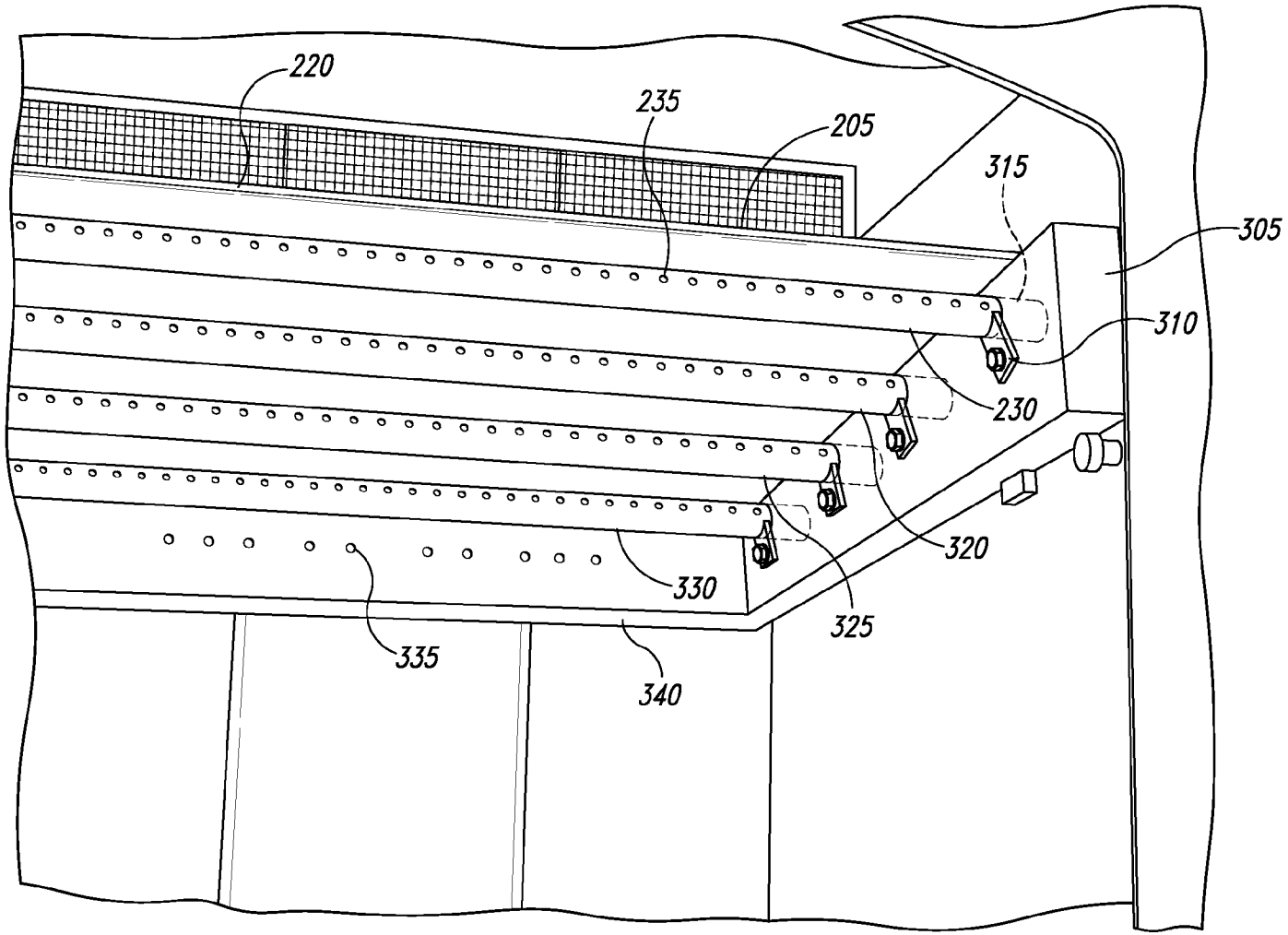
FIG. 3 is an enlarged partial front isometric view of the hybrid fireplace assembly of FIG. 1 showing the secondary combustion tubes in the firebox of the assembly.

Secondary combustion also occurs in the lower combustion chamber 210. Secondary combustion occurs adjacent to one or more secondary combustion tubes 230 that carry a secondary air supply. FIG. 3 is an enlarged front isometric view of the hybrid fireplace assembly 100 of FIG. 1 showing the secondary combustion tubes 230. In the illustrated embodiment, the hybrid fireplace assembly 100 includes four secondary combustion tubes 230, 320, 325, and 330. The number, size, and position of the secondary combustion tubes 230, 320, 325, and 330 can vary based on, as an example, the size of the firebox 105, the desired oxygen ($O_2$) level for mixture with the exhaust gases, and/or a variety of other factors.

The secondary combustion tubes 230, 320, 325, and 330 are mounted to common side chambers 305 (only one side chamber shown) by fasteners 310 (only one fastener shown). The side chambers 305 receive the open ends of the secondary combustion tubes 230, 320, 325, and 330, as illustrated by the broken line 315. The side chambers 305 are fluidly coupled to a secondary air supply, and freely provide this secondary air supply to the secondary combustion tubes 230, 320, 325, and 330. In some embodiments, the secondary air supply is warmed to within a particular temperature range in order to facilitate more efficient secondary combustion.

Each of the secondary combustion tubes 230 includes a plurality of air distribution holes 235 along the length of the tube that distribute the secondary air supply into the firebox 105. In some embodiments, the air distribution holes 235 are oriented at a selected angle relative to the baffle, such as substantially parallel or horizontally. The air distribution holes 235 direct the secondary air supply into the firebox 105 toward the leading edge 220 of the baffle 205. Such an arrangement of air distribution holes 235 helps to reduce or avoid turbulence between the secondary air supply and the burning fire, and allows the secondary air supply to blend with the flow of exhaust gases passing forwardly under the baffle 205, while maintaining an active flame in the firebox 105.

In the illustrated embodiment, each of the secondary combustion tubes 230, 320, 325, and 330 has air distribution holes 235 that are similarly spaced, sized, and oriented. In other embodiments, each of the secondary combustion tubes 230, 320, 325, and 330 has air distribution holes 235 that are differently spaced, sized, and/or oriented. The spacing, size, and/or orientation of the air distribution holes 235 can be based on the size of the firebox, the desired oxygen ($O_2$) level for mixture with the exhaust gases, and/or a variety of other factors. In the illustrated embodiments, the air distribution holes are shown below the baffle. In other embodiments, one or more secondary combustion tube 230 can be positioned, configured, or oriented to that a plurality of the air distribution holes are positioned above a portion of the baffle, e.g., above the leading edge area of the baffle, but still upstream of the catalytic converter discussed above. This arrangement can provide for an air flow above the baffle that mixes with the exhaust gases before passing through the catalytic converter.

As the secondary air supply is distributed into the firebox 105 by the air distribution holes 235, the secondary air supply mixes with the exhaust gases downstream of primary combustion and upstream of the leading edge 220 of the baffle 205, removing additional particulate emissions from the exhaust gases. The secondary combustion tubes 230, 320, 325, and 330 are more effective at reducing particulate emissions at higher temperatures. Accordingly, fewer particulate emissions remain to be removed during the tertiary and catalytic combustion stages, described herein. At lower temperatures, the secondary combustion tubes 230, 320, 325, and 330 are less effective at reducing particulate emissions. Accordingly, more particulate emissions remain to be removed during the tertiary and catalytic combustion stages.

Conventional secondary combustion tubes used by existing non-catalytic fireplace assemblies are not used in the hybrid wood burning fireplace assembly 100 described herein. For example, to obtain a desired level of particulate emissions at high temperatures, secondary combustion tubes with a conventional size, orientation, hole distribution, etc., generate a high level of excess air. If these conventional secondary combustion tubes were to be combined with a catalytic converter, the conventional tubes would provide an excessive flow of air (including too much oxygen) around the baffle and through the catalytic converter, resulting in ineffective use of the catalytic converter. Accordingly, the secondary combustion tubes in the hybrid wood burning fireplace assembly 100 described herein must be configured with a desired size, spacing, and/or orientation of the air distribution holes of the tubes, based at least in part upon the configuration of the firebox, the catalytic converter, and other factors.

In some embodiments, secondary combustion includes a rear air supply in addition to the secondary air supply. In the illustrated embodiment, a back wall chamber 340 mounted to the back wall 115 is fluidly coupled to a rear air supply. The back wall chamber 340 includes a plurality of rear air distribution holes 335. Like the air distribution holes 235 of the secondary combustion tubes 230, the rear air distribution holes 335 in the illustrated embodiment are spaced substantially horizontally, such that they direct a rear air supply into the firebox 105 toward the leading edge of the baffle 205. This arrangement of rear air distribution holes 335 helps to reduce or avoid turbulence between the rear air supply and the burning fire, allowing the rear air supply to blend with the flow of exhaust gases passing forwardly under the baffle 205, while maintaining an active flame in the firebox 105.

Like the air distribution holes 235 of the secondary combustion tubes 230, the rear air distribution holes 335 can be evenly spaced across the surface of the back wall chamber 340. In other embodiments, including the illustrated embodiment, the rear air distribution holes 335 are variably spaced across the surface of the back wall chamber 340. Such variations in the placement of the rear air distribution holes 340 can be based on the size of the firebox, the desired oxygen ($O_2$) level for mixture with the exhaust gases, and/or a variety of other factors. Alternatively or additionally, variations can be made in the size and orientation of the rear distribution air holes 340 based on similar factors.

The presence or absence of a back wall chamber 340 can be determined based on the size of the firebox, the desired oxygen ($O_2$) level for mixture with the exhaust gases, and/or a variety of other factors. For example, a small hybrid fireplace assembly 100, which generates relatively fewer particulate emissions, requires a smaller overall air supply for combustion of the particulate emissions. Accordingly, the back wall chamber 340 may have relatively fewer rear air distribution holes 355, or the back wall chamber may be omitted altogether. A large hybrid fireplace assembly 100, which generates relatively more particulate emissions, typically requires a larger overall air supply for combustion of the particulate emissions. Accordingly, the back wall chamber 340 may have more rear air distribution holes 340 and/or larger rear air distribution holes 355.

Returning to FIG. 2, tertiary combustion takes place downstream of the secondary combustion tubes 230 and upstream of the catalytic converter 245. The leading edge 220 of the baffle 205 forms an exhaust passageway 240 adjacent to the front wall 110 of the firebox 105. The exhaust gases from the burning fire are directed from the lower combustion chamber 210, through the exhaust passageway 240, and into the upper combustion chamber 215. A tertiary air supply mixes with the exhaust gases in the exhaust passageway 240, removing additional particulate emissions.

The tertiary air supply can be distributed into the firebox 105 from a variety of locations, such as an air wash passageway 255 adjacent to the interior of the front wall 110 and near the top of the front wall. The tertiary air supply in the illustrated embodiment is directed downwardly through the exhaust passageway 240 and across the face of the window 150. In addition to removing particulate emissions from the exhaust gases, the tertiary air supply can help cool and/or clean the surface of the window 150.

As previously described, the hybrid combustion system includes both catalytic and non-catalytic components. Once the exhaust gases have passed through the primary, secondary, and tertiary combustion stages, the exhaust gases enter the catalytic combustion stage. Catalytic combustion takes place in the upper combustion chamber 215. As previously described, the catalytic converter 245 is mounted above the baffle 205 so that all of the exhaust gases will pass through the catalytic converter 245 before entering the exhaust flue. The catalytic converter 245 is positioned rearward of the leading edge 220 of the baffle 205, such that the exhaust gases mix with sufficient air during secondary and tertiary combustion to achieve desired oxygen ($O_2$) levels before entering the catalytic converter. In the illustrated embodiment, the desired oxygen level is within in the range of 5-6%, while other embodiments, the desired oxygen level falls within a different range. The desired oxygen level may be based in part on the size of the hybrid fireplace assembly 100, in addition to other factors. If the catalytic converter 245 is positioned too close to the leading edge 220 of the baffle 205, the exhaust gases may not mix with enough air during secondary and tertiary combustion, causing the catalytic converter to be used ineffectively.

Figure 4:
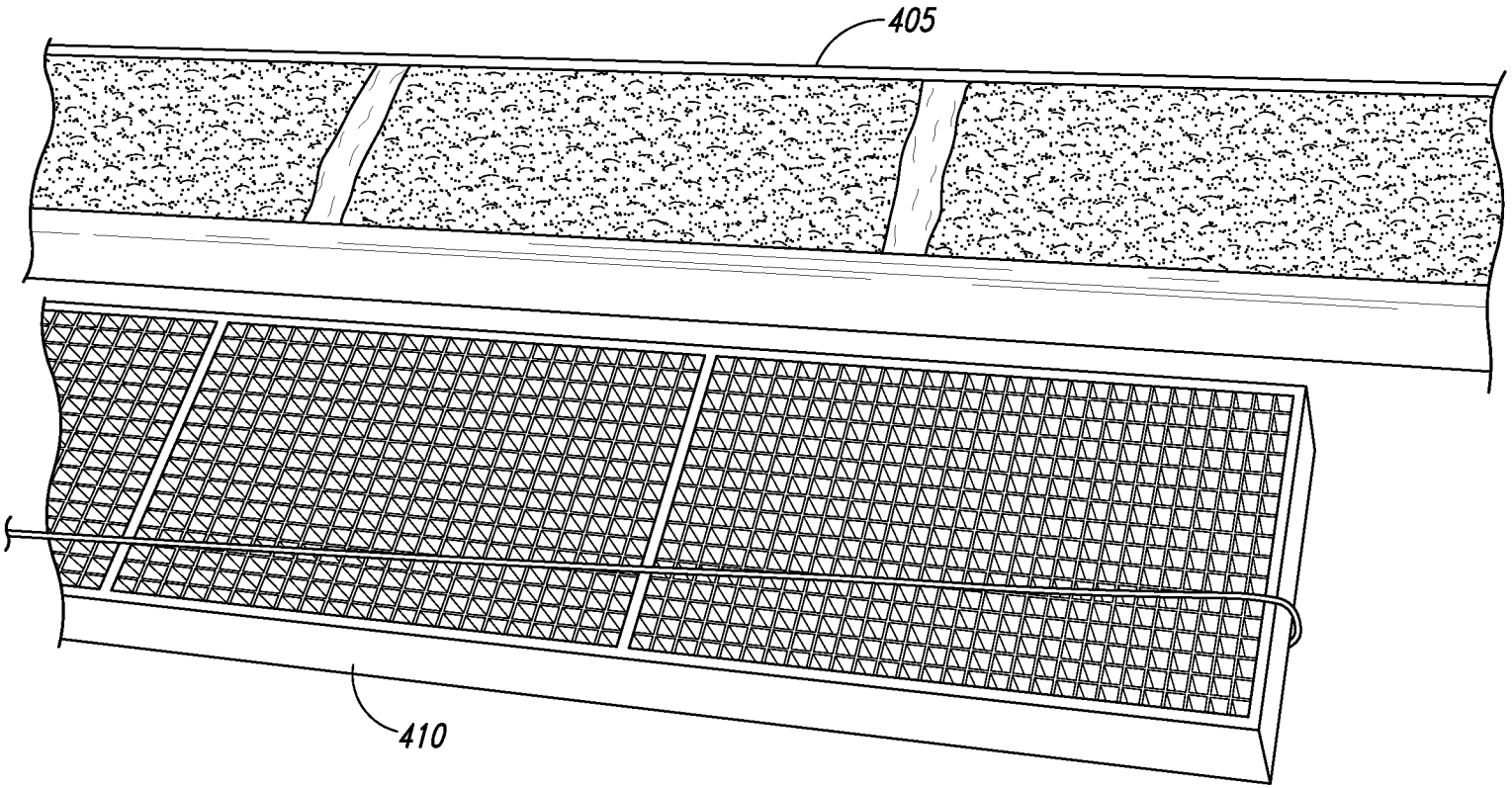
FIG. 4 is an enlarged, partial isometric view of the catalytic converter of the hybrid combustion system of FIG. 2.

FIG. 4 is a front isometric view of the catalytic converter 245 of FIG. 2. The catalytic converter 245 is a honeycomb 410, steel wool 405, or other base or matrix structure coated with selected metals, such as precious metals or the like. The surface properties of these metals are such that particulate emissions that are too cool to burn on their own will ignite when they react with the catalytic converter 245. In other words, the catalytic converter 245 provides a reaction with the components in the exhaust gas, such as the carbon monoxide, that causes portions of the catalytic converter to heat up to a temperature so as to cause the particulate emissions to burn and be substantially removed from the exhaust. In the illustrated embodiment, the catalytic converter 245 is serviceable, and may be removed for repair and/or replacement as necessary.

The catalytic converter 245 reacts with the exhaust gases downstream of tertiary combustion and upstream of the flue adapter 165, removing additional particulate emissions from the exhaust gases before these gases reach the flue adapter 165. As previously discussed, at higher temperatures, the secondary combustion tubes 230, 320, 325, and 330 are more effective at reducing particulate emissions, and the catalytic converter 245 is used relatively less. At lower temperatures, the secondary combustion tubes 230, 320, 325, and 330 are less effective at reducing particulate emissions, and the catalytic converter 245 is used relatively more. Regardless of the temperature, the catalytic converter 245 is configured to allow sufficient air to flow therethrough in order to maintain an active flame in the firebox 105.

Figure 5:
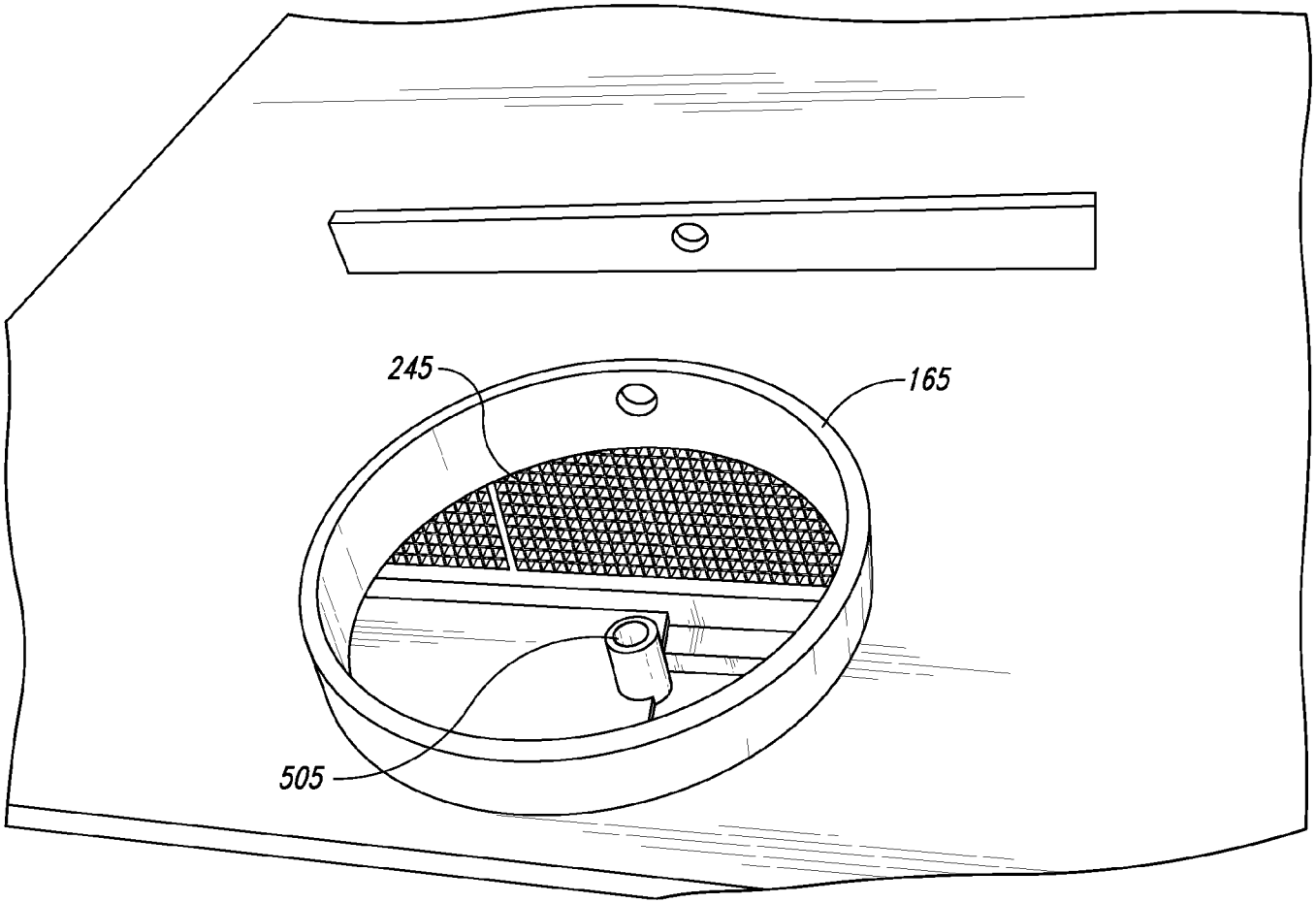
FIG. 5 is an enlarged, partial top isometric view of the fireplace assembly of FIG. 1 showing a portion of the catalytic converter and a bypass damper visible through an exhaust aperture when the exhaust flue is removed.

The catalytic converter 245 can be engaged and disengaged via a bypass damper. FIG. 5 is a top isometric view of the fireplace assembly 100 of FIG. 1 showing a bypass damper 505. In some embodiments, a damper control (not shown) is provided to allow the user to selectively open and close the bypass damper 505. The damper control can extend along the top plate 125 through a damper control opening 510. When the bypass damper 505 is closed, the exhaust gases generated by the burning fire must flow through the catalytic converter 245 before reaching the flue adapter 165. When the bypass damper is open, the exhaust gases may flow around the catalytic converter 245 and reach the flue adapter 165 without being processed by the catalytic converter. In the illustrated embodiment, the bypass damper 505 is downstream of the catalytic converter 245. However, in other embodiments, the bypass damper 505 is located upstream of the catalytic converter 245.

The hybrid fireplace assembly 100 described herein allows for the use of a thinner catalytic converter 245 than those used in conventional catalytic fireplace assemblies. Conventional catalytic fireplace assemblies (which do not include non-catalytic secondary combustion tubes 230, 320, 325, and 330) generally have catalytic converters that are 2-4" thick, depending on the size of the firebox. Because the hybrid fireplace assembly 100 described herein reduces particulate emissions during primary, secondary, and tertiary combustion, there are fewer particulate emissions to be processed by the catalytic converter 245. Accordingly, the hybrid fireplace assembly 100 allows for use of a thinner catalytic converter 245. In some embodiments, the catalytic converter 245 employed by the hybrid fireplace assembly 100 is 1-2" thick, depending on the size of the firebox 105. That is, in some embodiments, the reduction in the size of the catalytic converter 245 over those used by conventional catalytic fireplace assemblies is approximately fifty percent. Among other benefits, the reduction in the size of the catalytic converter 245 lowers the cost of the catalytic converter, and thus the cost of the fireplace assembly 100.

The hybrid fireplace assembly 100 described herein achieves better particulate emission levels than both conventional catalytic fireplace assemblies and conventional non-catalytic fireplace assemblies having secondary combustion tubes. A standard catalytic fireplace assembly achieves a maximum particulate emission level of approximately 2.5 grams/hour, while a standard non-catalytic fireplace assembly having secondary combustion tubes achieves a maximum particulate emission level of approximately 4.5 grams/hour. In contrast, the hybrid fireplace assembly 100 described herein achieves a maximum particulate emission level of approximately 1.0 grams/hour.

The above description of illustrated embodiments of the disclosure is not intended to be exhaustive or to limit the invention to the precise form disclosed. While specific embodiments of, and examples for, the disclosure are described herein for illustrative purposes, various equivalent modifications are possible within the scope of the disclosure, as those skilled in the relevant art will recognize. The teachings of the disclosure herein can be applied to other wood burning fireplace assemblies, not necessarily the assemblies described above.

While certain aspects of the disclosure are presented below in certain claim forms, the inventors contemplate the various aspects of the disclosure in any number of claim forms. In general, in the following claims, the terms used should not be construed to limit the disclosure to the specific embodiments disclosed in the specification and claims, but should be construed to include all components and methods of manufacturing the components, in accordance with the claims. Accordingly, the disclosure is not limited by the description, but instead the scope of the disclosure is to be determined entirely by the claims.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A hybrid fireplace assembly, comprising:

a fire box with an interior area configured to contain a combustible fuel that will burn and generate exhaust, the firebox having a front wall, a back wall, sidewalls, a base plate, a top portion, and an exhaust outlet;

a baffle connected to the firebox and disposed in the interior area to define a lower combustion chamber below the baffle and an upper combustion chamber above the baffle, the lower combustion chamber being sized and shaped to contain at least a portion of the fire from burning combustible fuel, the upper combustion chamber having an upper exhaust passageway between baffle and the top portion of the firebox;

a primary combustion air passageway configured to carry primary combustion air to the lower combustion chamber, the primary combustion air passageway having an inlet that receives air therein for primary combustion and having at least one outlet in the firebox that directs primary combustion air toward the fire in the lower combustion chamber;

a secondary combustion air passageway configured to carry secondary combustion air into the firebox, the secondary combustion air passageway having an inlet that receives air therein for secondary combustion of at least portions of exhaust from the burning of the combustible fuel in the lower combustion chamber, the secondary combustion air passageway having air outlets in the firebox that directs the secondary combustion air adjacent to the baffle to mix with the exhaust for non-catalytic secondary combustion of the exhaust before the exhaust flows through the upper exhaust passageway;

a catalytic combustion unit in the firebox and positioned above the baffle and across the upper exhaust passageway whereby the exhaust will pass through the catalytic combustion unit after the non-catalytic secondary combustion of the exhaust and before the exhaust exits the upper combustion chamber through the upper exhaust passageway, the catalytic combustion unit configured to remove combustion byproducts from the exhaust when the exhaust passes through the catalytic combustion unit; and a bypass damper connected to the top portion of the firebox and moveable between closed and open positions, in the closed position the bypass damper blocks the exhaust from flowing therethrough and the exhaust must flow through the catalytic combustion unit, and in the open position at least a portion of the exhaust can flow therethrough without passing through the catalytic combustion unit.

2. The assembly of claim 1 wherein the baffle comprises a support structure that supports an insulation layer that forms an upper portion of the baffle.

3. The assembly of claim 2 wherein the insulation layer includes at least one of firebricks, ceramic fiber and vermiculite board.

4. The assembly of claim 1 wherein the baffle is sloped relative to the base plate.

5. The assembly of claim 1 wherein the hybrid fireplace assembly is at least one of a wood-burning fireplace unit, wood-burning stove, and a wood-burning fireplace insert.

6. The assembly of claim 1 wherein the secondary combustion air passageway comprises a secondary combustion air tube positioned below the baffle.

7. The assembly of claim 1 wherein the baffle has a leading edge spaced apart from the firebox to define a portion of the exhaust passageway adjacent to the leading edge of the baffle, and the catalytic combustion unit is connected to the baffle generally adjacent to the leading edge, away from the exhaust outlet, and spaced away from the leading edge of the baffle by a selected distance to allow the exhaust to mix with air during secondary and tertiary combustion to achieve selected oxygen levels before entering the catalytic combustion unit.

8. The assembly of claim 1 wherein the catalytic combustion unit is a catalytic converter.

9. The assembly of claim 1 wherein the secondary combustion air passageway is configured to facilitate the combustion of exhaust particles in a first range of temperatures with a first level of efficiency, and the catalytic combustion unit being configured to provide combustion of exhaust particles in the first range of temperatures with a second level of efficiency less than the first level of efficiency.

10. The assembly of claim 9 wherein the secondary combustion air passageway is configured to facilitate the combustion of exhaust particles in a second range of temperatures less than the first range of temperatures with a third level of efficiency, and the catalytic combustion unit being configured to provide combustion of exhaust particles in the range of second temperatures with a fourth level of efficiency greater than the third level of efficiency.

11. A hybrid wood-burning fireplace assembly configured for burning wood-based fuel, wherein the burning generates combustion exhaust, the assembly comprising:

a fire box having an interior area, a base portion, and a top portion with an exhaust outlet;

a baffle in the interior area defining a lower combustion chamber below the baffle and an upper combustion chamber above the baffle, the upper combustion chamber having an upper exhaust passageway between baffle and the top portion of the firebox;

a primary combustion airway having an inlet that receives primary combustion air therein and having at least one outlet in the firebox that directs the primary combustion air to the lower combustion chamber for primary combustion with the burning wood-based fuel;

a secondary combustion airway having an inlet that receives air therein for secondary combustion of at least portions of exhaust from the burning wood-based fuel in the lower combustion chamber, the secondary combustion airway having air outlets in the firebox that directs the secondary combustion air adjacent to the baffle to mix with the exhaust for non-catalytic secondary combustion of the exhaust before the exhaust flows through the upper exhaust passageway; and a catalytic combustion unit in the firebox and supported on the baffle spaced apart from the exhaust outlet and across the upper exhaust passageway whereby the exhaust will pass through the catalytic combustion unit after the non-catalytic secondary combustion of the exhaust and before the exhaust exits the upper combustion chamber through the upper exhaust passageway;

wherein the air outlets of the secondary combustion airway are sized and positioned as a function of a size of the firebox, a desired oxygen level for mixture with the exhaust gasses prior to secondary combustion, and the catalytic combustion unit to provide; and wherein the combustion exhaust entering the exhaust outlet has a maximum particulate emission level of up to approximately 1.0 grams/hour.

12. The assembly of claim 11 wherein the baffle is sloped relative to the base plate.

13. The assembly of claim 11 wherein the baffle comprises a support structure that supports an insulation layer that forms an upper portion of the baffle.

14. The assembly of claim 11 wherein the hybrid wood-burning fireplace assembly is at least one of a wood-burning fireplace unit, wood-burning stove, and a wood-burning fireplace insert.

15. The assembly of claim 11 wherein the secondary combustion airway comprises a plurality of secondary combustion air tubes positioned below the baffle.

16. The assembly of claim 11 wherein the baffle has a leading edge spaced apart from the firebox to define a portion of the exhaust passageway adjacent to the leading edge of the baffle, and the catalytic combustion unit is connected to the baffle generally adjacent to the leading edge and is spaced away from the leading edge of the baffle by a selected distance to allow the exhaust to mix with air during secondary and tertiary combustion to achieve selected oxygen levels before entering the catalytic combustion unit.

17. The assembly of claim 11 wherein the secondary combustion airway is configured to facilitate the combustion of exhaust particles in a first range of temperatures with a first level of efficiency, and the catalytic combustion unit is configured to provide combustion of exhaust particles in the first range of temperatures with a second level of efficiency less than the first level of efficiency.

18. The assembly of claim 17 wherein the secondary combustion airway is configured to facilitate the combustion of exhaust particles in a second range of temperatures less than the first range of temperatures with a third level of efficiency, and the catalytic combustion unit is configured to provide combustion of exhaust particles in the range of second temperatures with a fourth level of efficiency greater than the third level of efficiency.

19. A method of reducing emissions from a wood-based fuel burning fireplace assembly, comprising:

burning a wood-based fuel in firebox of the fireplace assembly during primary combustion of the fuel to generate exhaust with particulates therein, the fireplace assembly having a baffle in the firebox that divides an interior area into an upper combustion chamber and a lower combustion chamber, the upper combustion chamber having an upper exhaust passageway between baffle and a top portion of the firebox;

directing secondary combustion air into the lower chamber below the baffle for mixing with the exhaust for secondary combustion of the exhaust in the firebox;

burning particulates in the exhaust in the secondary combustion adjacent to the baffle;

passing a first portion of the exhaust after the secondary combustion through a catalytic combustion unit positioned across an exhaust passageway in the upper combustion chamber above the baffle, wherein passing the exhaust through the catalytic combustion unit removed additional particulates from the exhaust after the secondary combustion;

passing a second portion of the exhaust after the secondary combustion through a bypass to an exhaust outlet in the firebox whereby the second portion of the exhaust does not flow through the catalytic combustion unit and directing the first portion of the exhaust out of the firebox through the exhaust outlet after the first portion of the exhaust exits the catalytic combustion unit and passing the second portion of the exhaust through the exhaust outlet after the second portion of the exhaust exits the exhaust bypass.

20. The method of claim 19 wherein directing secondary combustion air into the lower combustion chamber below the baffle includes passing the secondary combustion air through a secondary combustion air tube and directing the air through outlets in the secondary combustion air tube into the lower combustion chamber below the baffle for mixing with the exhaust for secondary combustion of the exhaust in the firebox.

* * * * *